US006684865B2

(12) United States Patent
Hilpert

(10) Patent No.: US 6,684,865 B2
(45) Date of Patent: Feb. 3, 2004

(54) PRESSURE CONTROL VALVE WITH PRESSURIZED MEMBRANE

(75) Inventor: Torsten Hilpert, Erdmannhausen (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/005,870

(22) Filed: Dec. 7, 2001

(65) Prior Publication Data

US 2002/0083935 A1 Jul. 4, 2002

(30) Foreign Application Priority Data

Dec. 8, 2000 (DE) ..... 100 61 306

(51) Int. Cl.[7] ..... F01M 13/00
(52) U.S. Cl. ..... 123/574; 123/41.86; 137/510
(58) Field of Search ..... 123/41.86, 574; 137/510

(56) References Cited

U.S. PATENT DOCUMENTS 3,762,681 A * 10/1973 McKinney et al. ..... 137/510
4,295,457 A * 10/1981 Schleiermacher ..... 123/574
5,090,393 A 2/1992 Holch ..... 123/574
5,647,337 A * 7/1997 Johnson et al. ..... 123/572
5,727,529 A * 3/1998 Tuckey ..... 123/514

FOREIGN PATENT DOCUMENTS

| | | |
|---|---|---|
| DE | 19501447 | 7/1996 |
| GB | 2078341 | 6/1980 |

* cited by examiner

*Primary Examiner*—Stephen M. Hepperle
(74) *Attorney, Agent, or Firm*—Crowell & Moring LLP

(57) ABSTRACT

A pressure control valve with a pressurized membrane (5) for closing and opening a gas passage (7) in which a valve chamber (8) pressurized with an ambient pressure ($P_{amb}$) is located on the side of membrane (5) that is opposite the gas passage (7) to be closed and opened. The pressure control valve (1) is arranged in such a way that the exit of the gas passage (7) leads directly into a volume with ambient pressure ($P_{amb}$). The membrane (5) includes a ventilation hole (9) through which the valve chamber (8) is directly pressurized with ambient pressure ($P_{amb}$).

11 Claims, 1 Drawing Sheet

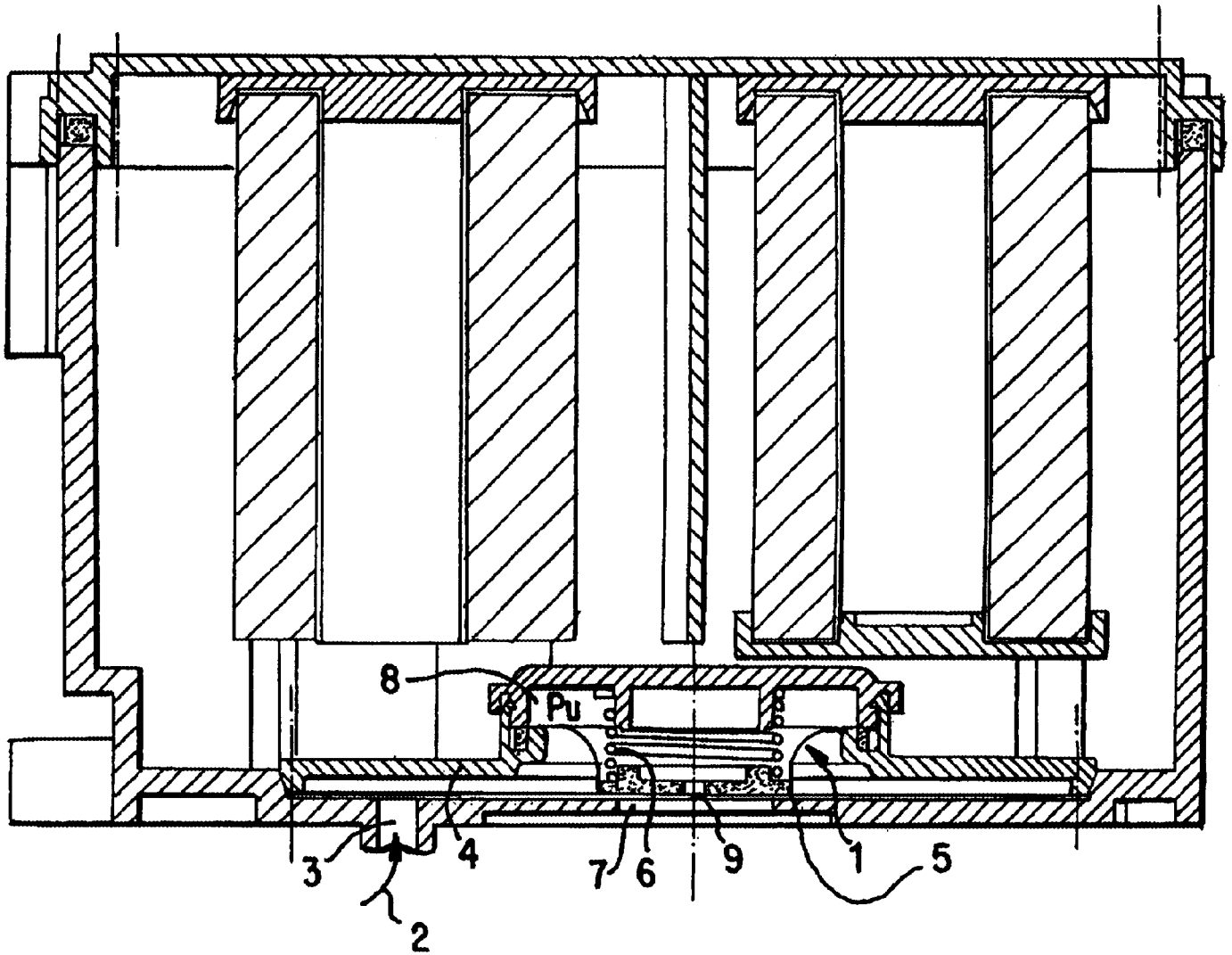
5
1
9
6
7
Pu
8
4
2
3

PRESSURE CONTROL VALVE WITH PRESSURIZED MEMBRANE

BACKGROUND OF THE INVENTION

The invention relates to a pressure control valve with a pressurized membrane for closing and opening a gas passage.

Holch, U.S. Pat. No. 5,090,393, for instance, discloses the integration of a pressure control valve in an intake path for the internal combustion engine of a motor vehicle. This pressure control valve is, for instance, installed in a ventilation line between the crankcase and the air intake duct or the air filter, or into the ventilation line of the fuel tank in a motor vehicle by means of two flanges. In each case, the object is to prevent the pressure or the negative pressure in the units that are to be vented from exceeding a predefined value. To this end, a membrane is provided, which by opening a duct, for instance against the force of a valve spring, controls the passage and closes it if necessary.

In this known arrangement, on the membrane side opposite the unit to be vented, a ventilation bore is present inside the valve housing, which pressurizes the valve chamber with atmospheric pressure. In many applications, however, the supply of atmospheric pressure is very complex, for example, if the pressure control valve is located in a sealed pressure chamber. In this case, the atmospheric or ambient pressure would have to be supplied by means of an additional duct or a hose or the like.

SUMMARY OF THE INVENTION

It is an object of the invention to provide an improved pressure control valve with a pressurized membrane for opening and closing a gas passage.

Another object of the invention is to provide a pressure control valve with a pressurized membrane for opening and closing a gas passage which is simply constructed in a space-saving manner.

It is also an object of the invention to provide a pressure control valve with a pressurized membrane for opening and closing a gas passage which can produced in a cost effective manner.

A still further object of the invention is to provide a pressure control valve with a pressurized membrane for opening and closing a gas passage which can be used to control venting of crankcase gases to an air intake of an internal combustion engine.

These and other objects of the invention are achieved by providing a pressure control valve with a pressurized membrane for closing and opening a gas passage, in which a valve chamber pressurized with an ambient pressure ($P_{amb}$) is provided on the side of the membrane opposite the gas passage to be closed and opened; the pressure control valve is arranged such that the gas passage has an exit which leads directly into a volume with ambient pressure ($P_{amb}$), and in the membrane there is a ventilation hole through which the valve chamber is directly pressurized with ambient pressure ($P_{amb}$).

Advantageously, the pressure control valve is arranged in such a way that the exit of the gas passage leads directly into a volume with ambient pressure, typically atmospheric pressure. The membrane comprises a ventilation hole, e.g., a bore, through which a valve chamber present on the side of the membrane opposite the gas passage to be closed and opened can be directly pressurized with ambient pressure.

The membrane in the valve chamber during closing is preferably pushed against the gas passage opening under pressure of a helical spring. The pressure control valve according to the invention can be easily used in an arrangement for venting a crankcase to the air intake tract of an internal combustion engine. It is advantageous that the pressure control valve can be integrated directly into a pressure body to save space without taking into account venting ducts, since it is unnecessary to construct any additional hoses or ducts in the device.

These and other features of preferred embodiments of the invention, in addition to being set forth in the claims, are also disclosed in the specification and/or the drawing, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTON OF THE DRAWING

The invention will be described in further detail hereinafter with reference to an illustrative preferred embodiment shown in the accompanying drawing FIGURE which is a sectional side elevation of a pressure control valve according to the invention having a pressurized membrane for closing and opening a gas passage in a ventilation arrangement for a crankcase of an internal combustion engine in a motor vehicle.

DETAILED DESCRIPTION OF A PREFERRED EMBODIMENT

The FIGURE shows an arrangement with a pressure control valve 1. In practical operation, this pressure control valve 1, which is installed in a ventilation line between the air intake duct and the crankcase of an internal combustion engine (not shown), draws in blow-by gases from the engine crankcase in the direction of arrow 2.

Gas entry 3 is connected with the crankcase and is arranged at a distributor plate or a roll of a non-woven material. A membrane 5 is provided, which under pressure of a helical spring 6 abutting the housing of a valve chamber 8, is pushed against an opening 7 representing the gas passage, which can be closed by means of the membrane 5. The opening 7 leads into a volume with an ambient pressure Pamb, normally atmospheric pressure.

To assure that valve chamber 8 has ambient pressure as well, a ventilation hole 9 is arranged directly in the membrane 5, so that a movement of the membrane 5 to open and close the opening 7 can be effected directly by the pressure differences between the ambient pressure $P_{amb}$ and the pressure inside the crankcase of the engine.

The foregoing description and examples have been set forth merely to illustrate the invention and are not intended to be limiting. Since modifications of the described embodiments may occur to persons skilled in the art, the invention should be construed broadly to include all variations falling within the scope of the appended claims and equivalents thereof.

What is claimed is:

1. A pressure control valve with a pressurized membrane for closing and opening a gas passage, wherein a valve chamber pressurized with an ambient pressure ($P_{amb}$) is provided on the side of the membrane opposite the gas passage to be closed and opened;

the pressure control valve is arranged such that the gas passage has an exit which leads directly into a volume with ambient pressure ($P_{amb}$), and in the membrane there is a ventilation hole through which the valve chamber is directly pressurized with ambient pressure ($P_{amb}$).

2. A pressure control valve according to claim 1, wherein the ambient pressure ($P_{amb}$) is atmospheric pressure.

3. A pressure control valve according to claim 1, wherein the membrane in the valve chamber is pushed during closing against the gas passage opening under pressure of a spring.

4. A pressure control valve according to claim 1, wherein the pressure control valve is installed between a crankcase of an internal combustion and an air intake tract of said engine to control venting of crankcase gases from said crankcase to said air intake tract.

5. A pressure control valve comprising:

a membrane having a ventilation hole, the membrane dividing the control valve into first and second chambers;

an opening in the second chamber to ambient pressure, wherein the membrane is adapted to close and open the opening, and wherein the first chamber is in fluid communication with the ambient pressure through the opening and the ventilation hole; and an inlet adapted for connecting the second chamber to an engine crankcase.

6. A pressure control valve according to claim 5, wherein the ambient pressure is atmospheric pressure.

7. A pressure control valve according to claim 5, further comprising a spring biasing the membrane to close the opening.

8. A pressure control valve according to claim 5, wherein the spring is disposed in the first chamber.

9. A pressure control valve according to claim 5, wherein the ventilation hole is the only opening to the first chamber.

10. A pressure control valve according to claim 5, wherein the ventilation hole is within an area of the membrane used to close the opening.

11. A pressure control valve according to claim 5, wherein the pressure control valve is installed between the engine crankcase and an engine air intake tract to control venting of crankcase gases from the engine crankcase to the air intake tract.

* * * * *